United States Patent [19]

Prud'Hon

[11] Patent Number: 4,979,733

[45] Date of Patent: Dec. 25, 1990

[54] APPARATUS FOR TRAINING, INVESTIGATION AND RE-EDUCATION IN PARTICULAR FOR THE NEURO-MUSCULAR FUNCTION

[75] Inventor: Gerard Prud'Hon, Boulogne, France

[73] Assignee: Merobel-Societe Anonyme Francaise, Paris, France

[21] Appl. No.: 300,438

[22] Filed: Jan. 23, 1989

Related U.S. Application Data

[63] Continuation-in-part of Ser. No. 104,103, Oct. 5, 1987, abandoned.

[30] Foreign Application Priority Data

Oct. 13, 1986 [FR] France ..... 8614193

[51] Int. Cl.[5] ..... A63B 21/005

[52] U.S. Cl. ..... 272/129; 272/131; 272/135

[58] Field of Search ..... 272/72, 73, 125, 129, 272/131, 134, 135, 118, 144; 128/25 R, 25 B; 73/379; 254/389, 390, 394; 74/425

[56] References Cited

U.S. PATENT DOCUMENTS

| | | | |
|---|---|---|---|
| 3,387,493 | 6/1968 | Strittmatter | 73/379 |
| 4,135,714 | 1/1979 | Hughes . | |
| 4,184,678 | 1/1980 | Flavell et al. | 272/129 |
| 4,261,562 | 4/1981 | Flavell . | |
| 4,625,962 | 12/1986 | Street | 272/69 X |
| 4,674,741 | 6/1987 | Pasierb, Jr. et al. | 272/129 X |
| 4,678,184 | 7/1987 | Neiger et al. | 272/129 |
| 4,842,274 | 6/1989 | Oosthuizen et al. | 272/129 |

FOREIGN PATENT DOCUMENTS

| | | | |
|---|---|---|---|
| 0151066 | 1/1985 | European Pat. Off. . | |
| 0755285 | 8/1980 | U.S.S.R. | 272/71 |
| 8302236 | 7/1983 | World Int. Prop. O. . | |

*Primary Examiner*—Robert Bahr
*Assistant Examiner*—Joe H. Cheng
*Attorney, Agent, or Firm*—Kane, Dalsimer, Sullivan, Kurucz, Levy, Eisele and Richard

[57] ABSTRACT

The invention relates to apparatus for training, investigation, and re-education, in particular for the neuromuscular system. The invention is mounted on a fixed frame and includes a matched is kinetic work system and a programmable two force drive work system, each comprising a drum, a cord windable on the drum terminating with a handle for grasping by the operator. The invention further includes a return member urging the cord to wind on the drum. A motor with an irreversible stepdown gear is connected to the drum of both systems via a transmission so as to exert a force on the cord depending on its direction and speed of displacement.

25 Claims, 7 Drawing Sheets

FIG. 5
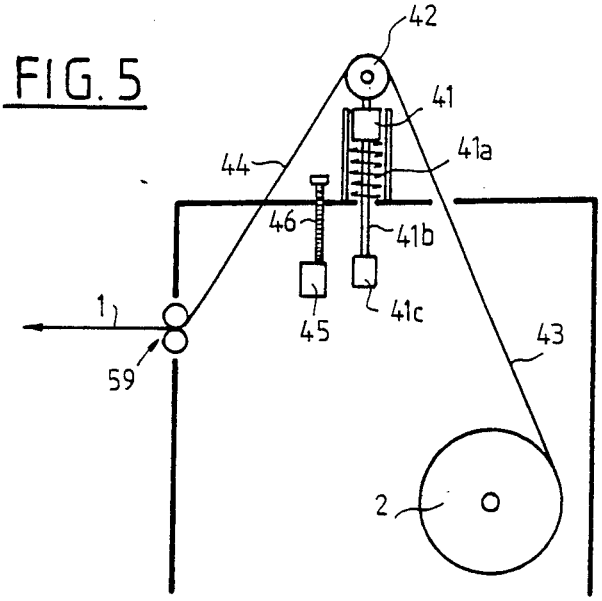
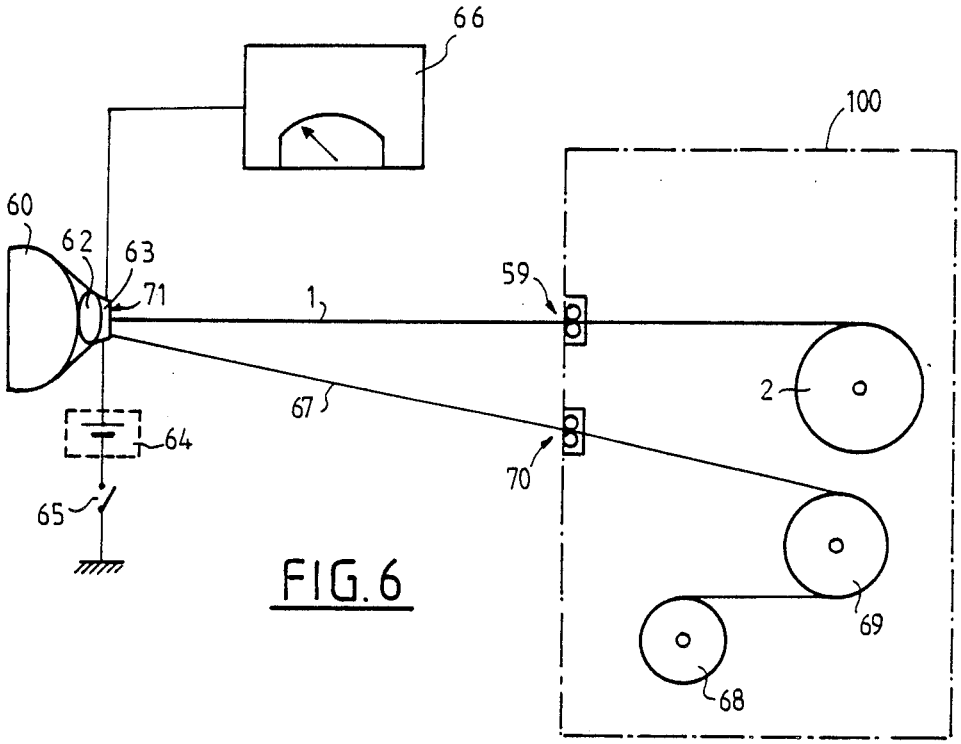
FIG. 6

APPARATUS FOR TRAINING, INVESTIGATION AND RE-EDUCATION IN PARTICULAR FOR THE NEURO-MUSCULAR FUNCTION

REFERENCE TO RELATED APPLICATION

This application is a continuation-in-part of U.S. application Ser. No. 104,103 filed Oct. 5, 1987, now abandoned.

The invention relates to apparatus for training, investigation, and re-education, in particular for the neuromuscular function.

FIELD OF THE INVENTION

U.S. Pat. No. 4,678,184 (Neiger et al), commonly assigned with this application, describes an apparatus of this type comprising:

a fixed frame;

a work member for connection to a subject to be exercised and capable of moving in a first direction and in a second direction opposite to the first one;

a return member connected to the work member in order to exert a force thereon tending to displace it in the first direction;

a drive member; and an irreversible transmission device suitable for transmitting a force from the drive member to the work member in said first direction , solely when the speed of the work member measured algebraically in the second direction is not less than a threshold.

BACKGROUND OF THE INVENTION

The term "irreversible transmission" is used herein for a transmission which prevents the work member from having any influence on the motion of the drive member.

In this prior apparatus, the work member comprises a rotary drum having a cord wound thereon, which cord is fixed to grasping means by which the subject exerts traction on the cord tending to unwind it from the drum. The drive member is a rotary motor, and the transmission device comprises an irreversible stepdown gear and a one-way transmission element constituted by a freewheel mounted in such a manner that its portion fixed to the drum cannot rotate more quickly in the direction corresponding to cord unwinding than its other portion which is fixed to the motor via the stepdown gear.

The return member comprises an electromagnetic clutch mounted via transmission means between the rotary motor and the drum in such a manner as to be capable of communicating motion to the drum in the cord-winding direction.

In this prior apparatus, when the subject is not exerting traction on the cord, the cord is wound in by the motion of the motor being transmitted to the drum via the clutch, since the freewheel does not prevent drum motion in this direction. When the subject pulls the cord at a speed such that the speed of rotation of the portion of the freewheel which is fixed to the drum remains less than the speed of rotation of its other portion, the subject must overcome a constant force defined by the resistance of the clutch as it slips. When the unwinding speed of the cord reaches a value corresponding to the two portions of the freewheel rotating at the same speed, the freewheel engages and transmits the force exerted by the subject to the stepdown gear. Because of its irreversible nature, the stepdown gear prevents this cord unwinding speed from being exceeded and applies a force which is equal and opposite to the force being exerted by the subject.

The above-described apparatus operates satisfactorily, but it is incapable of satisfying some of the operating conditions required by changes in therapeutic methods or in training for sport.

Further, it is desirable to provide a rational design of the various functions it performs together with the possibility of combining them simply and cheaply in order to widen its field of use.

The aim of the invention is thus to provide an apparatus whose design makes it possible simultaneously:

to implement the functions of the prior apparatus;

to add new functions; and to split the apparatus into modular groups of functions which are easily assembled or disassociated.

SUMMARY OF THE INVENTION

The invention thus re-uses two groups of existing functions:

drive function : the cord is wound onto the work pulley and pulls the subject connected to its end; the return force is adjustable; and resistive function : the cord is unwound from the work pulley under traction from the subject, but beyond a certain (adjustable) speed, the subject can no longer accelerate the motion. Such traction speed conditions are known as "isokinetic". The harder the subject pulls, the greater the resistance provided by the cord : the resistive force is "matched" to the force which the operator is capable of providing.

More specifically, the apparatus of the invention comprises :

a fixed frame;

at least one work member for connection to a subject to be exercised and capable of moving in a first direction and in a second direction opposite to the first one;

a respective return member including mechanical energy storing means, connected to each work member in such a way as to store energy in said mechanical storing means when said subject moves the work member in the second direction and to release energy when the work member moves in the first direction, said return member exerting a force on the work member tending to displace it in the first direction;

a drive member adapted to run in a given direction at a selected speed which may be zero speed; and an irreversible transmission device connected between the drive member and each work member in order to exert a force on the latter in said first direction, solely when the speed of the work member measured algebraically in the second direction is not less than a predetermined threshold proportional to said selected speed.

Thus, the invention adds the possibility of rapidly "reloading" the system, thanks to the mechanical energy storing means, enabling repetitive efforts to be made at a high rate.

It also adds "muscular relaxation functions" in which the muscle is extended at high speed and low force.

It further adds "safety functions" during muscular stretching by automatically "unclutching" the main force linkage beyond a certain cord wind- in speed.

It allows the drive force to be automatically programmed as a function of the direction of cord movement.

It adds a number of technological means that facilitate and extend use of the apparatus.

It provides a plurality of independent "work systems" usable separately or in combination and giving rise to an entire range of apparatuses by virtue of groups of functions being presented in modular form.

In one particular embodiment of the invention, the apparatus comprises two distinct and independent "work systems". One of the work systems is a "matched isokinetic" system and the other is a "programmable two force drive system".

The "matched isokinetic" work system essentially comprises :

a rotary drum onto which a cord fixed to grasping means is wound;

a rotary motor driving an irreversible stepdown gear, in particular a worm type gear, with a one-way transmission device, in particular a freewheel, mounted on the shaft thereof, the device being mounted in such a manner as to interconnect the rotary drum and the irreversible stepdown gear if the speed of rotation imparted to the rotary drum by the operator tends to exceed the selected speed for the output shaft of the stepdown gear; and a return member comprising a spiral spring bearing at one of its ends against a fixed point which is fixed to the frame and having its other end driving the rotary drum, either directly or else via a pulley whose diameter varies along its axis, and which draws on a cable that winds onto the pulley and which has one end attached to the drum. The return member applies a permanent traction force to the cord, and is generally adjusted to produce a low traction force in combination with a high wind-in speed on the cord if the operator relaxes the traction force applied thereto.

The assembly constituted by this isokinetic work system thus makes it possible to perform exercises with a "concentric" (cord traction direction) force matching the operator force and at a limited speed, together with an "eccentric" (cord release direction) force which is a low force at high speed. Concentric and eccentric exercises may be repeated at a high rate which is adjusted by the limiting speed selected for the concentric motion.

This system may be doubled up using a stepdown gear having two outlets, thereby enabling two limbs to be simultaneously and symmetrically exercised or else enabling two limbs to be exercised in alternation, or else allowing two operators to be exercised simultaneously.

The "programmable two force drive system" essentially comprises :

a rotary drum onto which a cord fixed to grasping means connected to the operator is wound;

a "low speed" power drive assembly comprising a motor, a transmission (or stepdown gear) whose outlet shaft is fixed to the drive element of an adjustable torque force coupler capable of being remotely-controlled and advantageously independent of the slip speed (for example an electromagnetic powder clutch). The driven element of the force coupler is connected via a one-way transmission element (for example a freewheel) to the rotary drum;

an auxiliary drive member, constituted in the same way as the return member of the above-described isokinetic work system and having a spiral spring which tends to produce a traction force to wind in the cord at low force but at high speed, with the rotary drum released from the action of the low speed force coupler by the freewheel disengaging enabling the operator to relax the force applied either to provide protection from too great a muscular elongation force in a zone of lower physiological strength, or else to enable a muscular relaxing phase to take place at low force, or else simply to activate the reloading stage of the device to make it possible to restart the muscular contraction motion.

Adjusting the force of the force coupler makes it possible to adjust the traction force exerted on the cord as it is wound onto the rotary drum. So long as the speed of the cord is less than the speed communicated to the drum from the motor and stepdown gear assembly via the force coupler, the force remains unchanged regardless of whether the cord is being wound out or is being wound in up to said limiting speed. Beyond the limiting wind-in speed, the freewheel disengages and the rotary drum is subjected solely to force from the return or auxiliary drive member.

The system may also include a device for detecting the direction of cord rotation, said device being constituted by a friction washer driven by the work member and driving a friction plate constrained to rotate between two abutments, at least one of which is fitted with a finger acting on a limitswitch which in turn acts on the selection of the force transmitted by the low speed force coupler (and in particular on the feed current to the electromagnetic powder clutch) in order to distinguish between the force produced while the cord is being wound out (muscular contraction) and while it is being wound in (muscular elongation).

Naturally, the two motor-and-stepdown-gear assemblies included in the two work systems could be distinct, but it is technically possible to use only one motor and stepdown gear assembly since both work systems operate at their own rate without imposing a rate on the other.

Similarly, the two systems may be used in succession by the same operator to perform exercises which are different in nature. They may thus be used to activate different physical portions of the same operator or to train two operators simultaneously.

The two systems may also be interconnected, with the second system cord being connected to the first system cord upstream from the first system cord grasping means, and with a pulley system enabling both cords to leave the support frame enclosing the mechanism via a single "window", with each cord being provided with its own abutment to limit its return stoke.

It may be observed that the following advantages are related to using this apparatus when both cords are interconnected.

The operator is then subjected to the superposition of the forces from the two cords : the operator can perform a specified concentric (muscular contraction) traction force up to the isokinetic speed limit, followed by a matched isokinetic force and then relax the force applied to the cord and perform an eccentric movement (muscular elongation) at a different force, and then completely relax the force on the cord under low muscular force.

Two important remarks can also be made :

not only is the use of a single irreversible motor and stepdown gear assembly for driving both work systems cheaper, it also provides a safety factor. The speeds of the cord during eccentric ($KN_O$) and isokinetic concentric ($N_O$) exercises are mutually related by the ratio of the work drum diameters. As a result, if the selected speed for isokinetic exercises is low, then the speed of eccentric movement under a powerful force is also low, and a proper rhythm is obtained for alternating exercises;

if the motor and stepdown gear unit is stopped, the first system cord cannot move, and an operator can be subjected to "static" traction exercises at a high level of force.

However, the second system cord is subjected only to the resistance of the force coupler which then acts as a brake. The traction movement of the cord under muscular contraction can be adapted depending on the exercise, but the return of the cord under muscular stretching depends solely on the force provided by the auxiliary member (low force, high speed) enabling considerable relaxation without providing external energy. It is thus possible to obtain the functions of a simplified training apparatus cheaply by fixing the second work system module on a fixed shaft instead of on the motor and stepdown gear assembly.

A simplified apparatus in accordance with the invention need only comprise the first or the second of the abovedescribed work systems.

In the first above-described system, the transmission device exerts a force on the work member when the same is moving in the second direction at a speed which is not less than the threshold, in absolute value.

In the second system, the transmission device exerts a force when the work member is moving in the second direction at any speed or is moving in the first direction at a speed which is not greater than the threshold in absolute value, said threshold being negative in this case.

Apparatus in accordance with the invention may also include two isokinetic systems for use simultaneously or separately by a single operator or by different operators. In particular, these two systems may be associated with two pulleys fixed to a common shaft and situated inside or outside the fixed frame of the apparatus, with the outlet cords of the two systems winding onto respective ones of the two pulleys in opposite directions. The shaft is then subjected to a zero return torque so long as its rotary motion takes place between the two speed thresholds as imposed by each of the two systems respectively, one in one direction of rotation and the other in the opposite direction. Any torque applied by an operator on said shaft at a speed which is not less than the threshold corresponding to the direction of rotation encounters an equal and opposite torque and the speed of rotation cannot exceed the threshold.

The various embodiments of the apparatus of the invention all have distinct advantages over the apparatus of U.S. Pat. No. 4,628,184.

The matched isokinetic system, alone or combined with another matched isokinetic system or with a programmable two force drive system, is less costly than the one of the prior Patent because it uses a simple mechanical return means instead of an electromagnetic power clutch connected between the motor and the work drum.

Further, this system can be used conveniently for static exercises with the motor stopped. In some cases where a limb has been severely injured, before subjecting it to dynamic exercises in which the limb exerts a force while in movement, it is desired to subject it to successive static exercises in which the limb exerts a static effort in positions which vary progressively over the range of the movement to be effected during the subsequent dynamic exercises, in order to heal the injury to an extent sufficiently for allowing it to perform the dynamic exercises. For this purpose, the motor is put in operation and the cord is unwound from the work drum until the grasping means reachs its outermost position corresponding to the series of static exercises, and then the motor is stopped. The limb is exercised by pulling on the cord with a controlled force, no displacement being allowed by the stopped motor and the irreversible transmission device. After exercise in this first position has been completed, the cord is allowed to wind up by the action of the spring return means until a second position is reached for performing a second exercise similar to the first one with the limb occupying a somewhat different position. The same operations are repeated until the limb has been exercised in all desired positions. The Neiger et al. apparatus cannot function in the same way because when the motor is stopped no rewinding force is available. It would be necessary to put the motor in operation for displacing the work cord before each static enercise.

The apparatus comprising two matched isokinetic systems has the further advantage of allowing fully independent training of two limbs of the same subject, or of two different subjects, using only one motor and one stepdown gear. When a work cord is winding up, or unwinding at a speed less than the threshold, the limb is only subjected to the traction force exerted by the corresponding return means. When the work cord is unwinding at the threshold speed, the transmission device applies thereto a resisting force equal to the force exerted by the limb, thus independent from the movement and force of the other limb, the threshold speed being also independent from the other limb.

Finally, the programmable two force drive system, alone or combined with another similar system or with a matched isokinetic system, provides an action which is entirely novel with respect to the Neiger et al. Patent, thus extending the training possibilities Specifically, the work cord can be unwound or wound up at any desired speed, and the limb is subjected to a selected traction force determined by the current in the electromagnetic clutch, as long as the cord unwinds, or winds up at a speed not exceeding the threshold, and to a lower traction force exerted by the return means when the winding up speed exceeds the threshold.

According to another characteristic of the invention, the apparatus includes means for varying the isokinetic speed threshold and/or the limit speed for the eccentric force effect. To this end, the rotary motor may be a variable speed motor, constituted, for example, by a DC or an AC motor whose speed is adjusted by a suitable electronic circuit. In simpler versions, it is also possible to use a two-speed, two-winding AC motor.

The uses to which the apparatus may be put can be widened by providing means for measuring the speed at which the work member moves, the distance moved by the work member during an exercise, and/or the force exerted by the subject on the work member It is also possible to provide signalling and/or metering means which are excited when a magnitude measured in this manner reaches a given value, and/or means for displaying the value of a measured magnitude as a function of time or as a function of some other measured magnitude.

Advantageously, the frame of the apparatus includes a cord outlet window having two pairs of parallel cylinders, with said two pairs being oriented in mutually perpendicular directions.

The invention also provides for fixing the frame to a chassis which supports a plate on which the subject may be placed while the apparatus is being used.

BRIEF DESCRIPTION OF THE DRAWINGS

Other characteristics of the invention appear from the following detailed description and from the accompanying drawings, in which :

FIGS. 4 to 6 are diagrams of devices for measuring the force exerted by the operator;

DETAILED DESCRIPTION OF THE INVENTION

Figure 1:
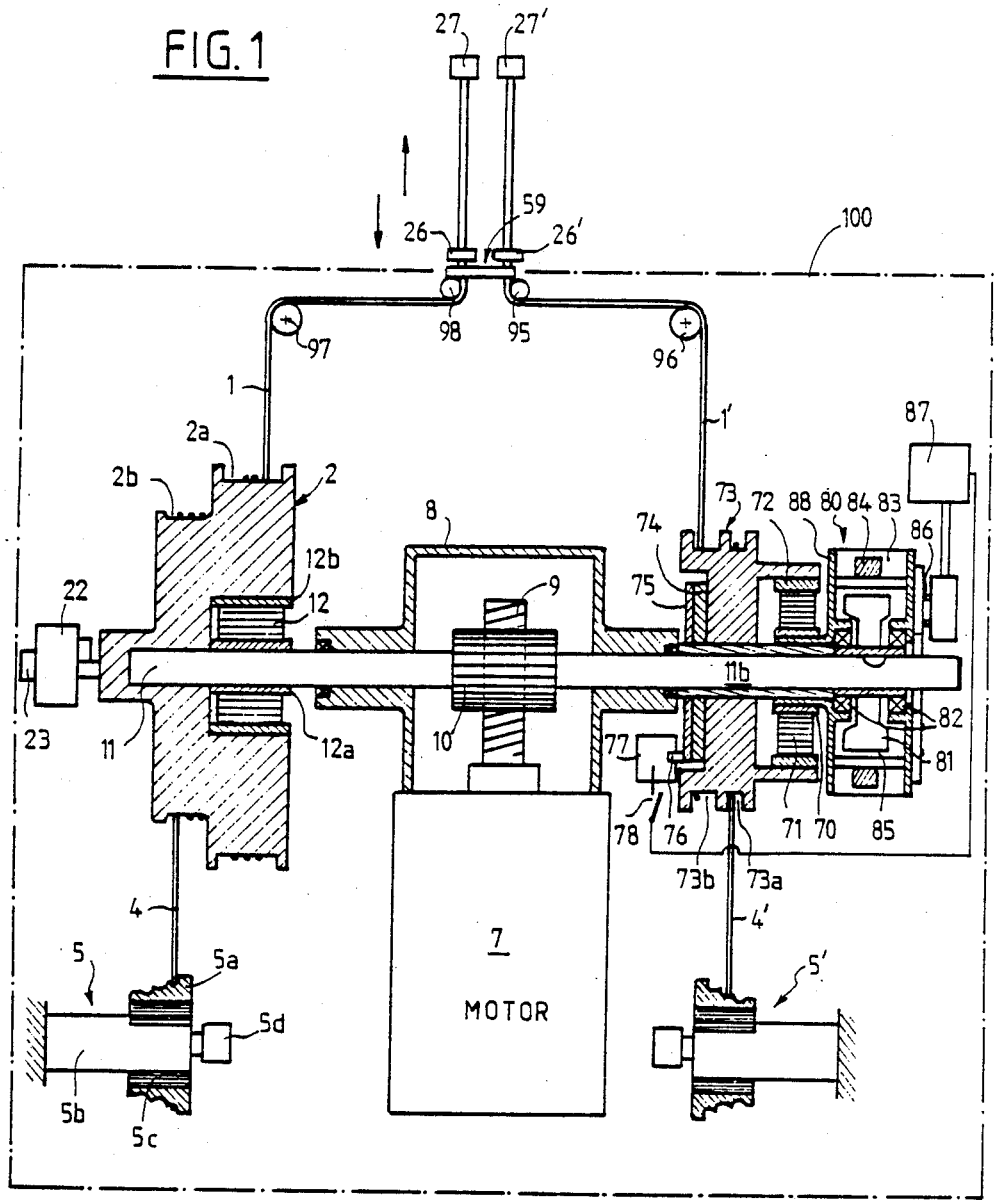
FIG. 1 is a diagrammatic representation of the mechanical components of an apparatus in accordance with the invention.

In order to limit the number of figures, some of the figures show different components among which one can choose for performing the same function and which are not normally present in the same apparatus.

The apparatus comprises a frame 100 represented by a single closed line within which a drum 2 is mounted fixed onto the outer ring 12*b* of a freewheel 12. The inner component 12*a* of the freewheel is fixed to an outlet shaft 11 from a stepdown gear 8 of the type comprising a worm and a worm wheel, said gear having a high gear ratio and being irreversible. The worm wheel 10 is driven by the worm 9 which is mounted on the shaft of a rotary motor 7.

The rotary drum 2 has a wide groove 2*a* onto which the cord 1 is wound, which cord passes through the wall of the frame and is terminated outside the frame by a grasping handle 27.

A set of pulley wheels 97 and 98 serve optionally to guide the cord 1 inside the frame to an outlet window 59 described below.

The rotary drum 2 also has a narrower groove 2*b* having the end of a cable 4 fixed thereto by means of a screw or any other appropriate rapid fastening means. The other end of the cable 4 is attached in the groove of a pulley 5*a* whose diameter advantageously varies along the axis in order to provide speed correction. The pulley 5*a* is connected to the outer end of the spiral spring 5*c* whose other end is connected to a fixed shaft 5*b* about which the cable is wound. When wound about the shaft 5*b*, the spring tends to rotate the pulley 5*a* and the drum 2 in such a manner as to wind the cord 1 onto the drum 2. A knob 5*d* serves to vary the tension of the spiral spring by modifying its fixing point relative to the fixed point of the shaft 5*b*.

The spring assembly 5 comprising items 5*a*, 5*b*, 5*c*, and 5*d* may be mounted at the end of the drum 2 in a simplified apparatus, thereby omitting the cable 4 and the groove 2*b*, and making it impossible to adjust forces and speeds. Such an assembly is manufactured, for example, by the firm REELS under the name AEROMOTIVE.

The above-described assembly constitutes the first work system referred to as the "matched isokinetic" system. When the motor rotates, it drives the shaft 11 of the stepdown gear at a speed $W_O$ in the opposite direction to that in which the return spring pulling on the cable 4 operates, and the cord 1 may move under the action of the operator while being subjected to the force of the spring 5*c* only, as transmitted at a ratio defined by the diameters of the pulleys 5*a*, 2*b*, and 2*a*.

If the speed N of the cord as it unwinds tends to exceed the speed $N_O$ corresponding to $W_O$, the freewheel 12 locks and connects the drum 2 to the shaft 11 whose speed is limited in irreversible manner. If the operator slows down the traction motion or even releases the cord, then the cord is re-wound under the effect of the spiral spring, thereby reloading the apparatus for the next exercise.

The second or "programmable two force drive" system is now described. The second shaft 11*b* of the stepdown gear has a force coupler 80 mounted thereon such as an electromagnetic powder clutch which may be of the type manufactured by MEROBEL under reference CT350. The inner portion 81 of the clutch is keyed to the shaft 11*b* and its ball bearings 82 support a driven inductor element 83 carrying a winding 84 which provides coupling in the powder contained in the gap 85 between the elements 81 and 84. This coupling depends on the direct current fed to the coil 84 via sliding contacts 86 which connect it to an adjustable DC generator 87. This enables the torque transmitted between the elements 81 and 84 to be adjusted.

A plate 88 fixed to the inductor 83 is rigidly fixed to the inside ring 70 of a freewheel 71 whose outside ring 72 is rigidly connected to a pulley 73 having two grooves 73*a* and 73*b*. One end of a cord 1' is fixed in the groove 73*b* and the other end of the cord is connected to grasping means 27' outside the frame 100 and passes over pulley wheels 95 and 96 in order to extend adjacent to the cord 1 and to pass through the same outlet window 59. The groove 73*a* receives a cable 4' connected to a spring assembly 5' similar to the assembly 5 and tending to rotate the pulley 73 in a direction suitable for winding in the cord 1'.

A friction washer 74 fixed to the pulley 73 drives a disk 75 which is fitted with a peg 76 that co-operates with a fixed abutment 77 in order to close a limitswitch 78 which acts on the input to the DC generator 87 when the cord 1' is being wound on the drum 73.

The freewheel 71 enables the drum pulley 73 to be coupled to the stepdown gear so long as the cord 1' is being wound out under the effect of operator traction exerted on the force handle 27'. It also enables this coupling to take place if the operator allows the cord to wind in at a speed which is less than the speed produced by the coupler connected to the shaft 11*b*. In contrast, the freewheel disengages if the cord 1' winds in at a higher speed. It is then driven solely by the cable 4' under the effect of the spring assembly 5'.

The force linkage acting on the cord 1' thus produces a constant force which is adjustable in regulated manner within the clutch 80 by means of the current from the 20 generator 87, so long as the speed of the cord 1' is negative (the operator is pulling) or so long as the speed is positive (the operator is not pulling) but less than a threshold speed $KN_O$ proportional to the threshold $N_O$ of the first work system. Beyond this speed, the cord is returned at high speed and low force by the device 5.

While the cord 1' is unwinding, the limitswitch 78 is open, thereby setting up a force in the force coupler 80 at a "concentric force" value.

While the cord 1' is being wound in, the limitswitch 78 is closed and causes the force coupler 80 to set up a force at an "eccentric force" value.

Each of these two forces may be independently adjusted.

It may be observed that the generator may be adjusted to a value which depends on other parameters such as the position of the cord which may be determined by a potentiometer 22 connected to one of the work drums 2 and 73.

The two cords 1 and 1' may be connected to the same force handle 27. Abutments 26 and 26' clamped to the cords 1 and 1' come into abutment against the window 59 and provide mechanical protection for the operator The following description concerns various different embodiments of the motor 7 and its power supply.

In the example shown in FIG. 1, the limiting speed at which the cord may be wound out is directly related to the speed of the motor. In order to make an apparatus which is as cheap as possible, a single phase electric motor is used of the current type, supplying a single limit speed.

Two limit speeds may be obtained by using a two-winding single phase 50/60 Hz motor, for example an industrial 2-pole/4-pole motor providing a 1 to 2 speed ratio, or better still a 2-pole/12-pole motor as conventionally used in washing machines providing a 1 to 6 ratio.

Under these conditions, the slower motor speed may be used for muscle-building exercises requiring slow speed with the cord often being extended only a little but in conjunction with considerable force (pelvis, chest, or legs and arms on their own); whereas the higher speed is suitable for high speed and/or long cord elongation muscle-building exercises using smaller forces (whole-body exercises where substantially all of the body plays a role in the speed and the amplitude of the movement).

When safety regulations make it impossible to use a high voltage power supply (next to swimming pools, running water), use may be made of a low voltage (12 volt or 24 volt) DC motor analogous to those used for starting cars. Where applicable, switching between 12 volts and 24 volts can be used to obtain two different unwinding limit speeds.

In professionnal apparatuses, for example apparatuses for re-education, it may be useful to provide a wide and continuous range of speeds, for example making it possible to perform the same type of training at progressively increasing speed, with patient progress being manifested by performing the same movement at constant force but at ever increasing speed. To this end, it is possible to use an adjustable speed motor such as a variable frequency AC motor in association with a conventional frequency varier, or a DC motor associated with an electronic control circuit of the type shown in FIG. 2.

Figure 2:
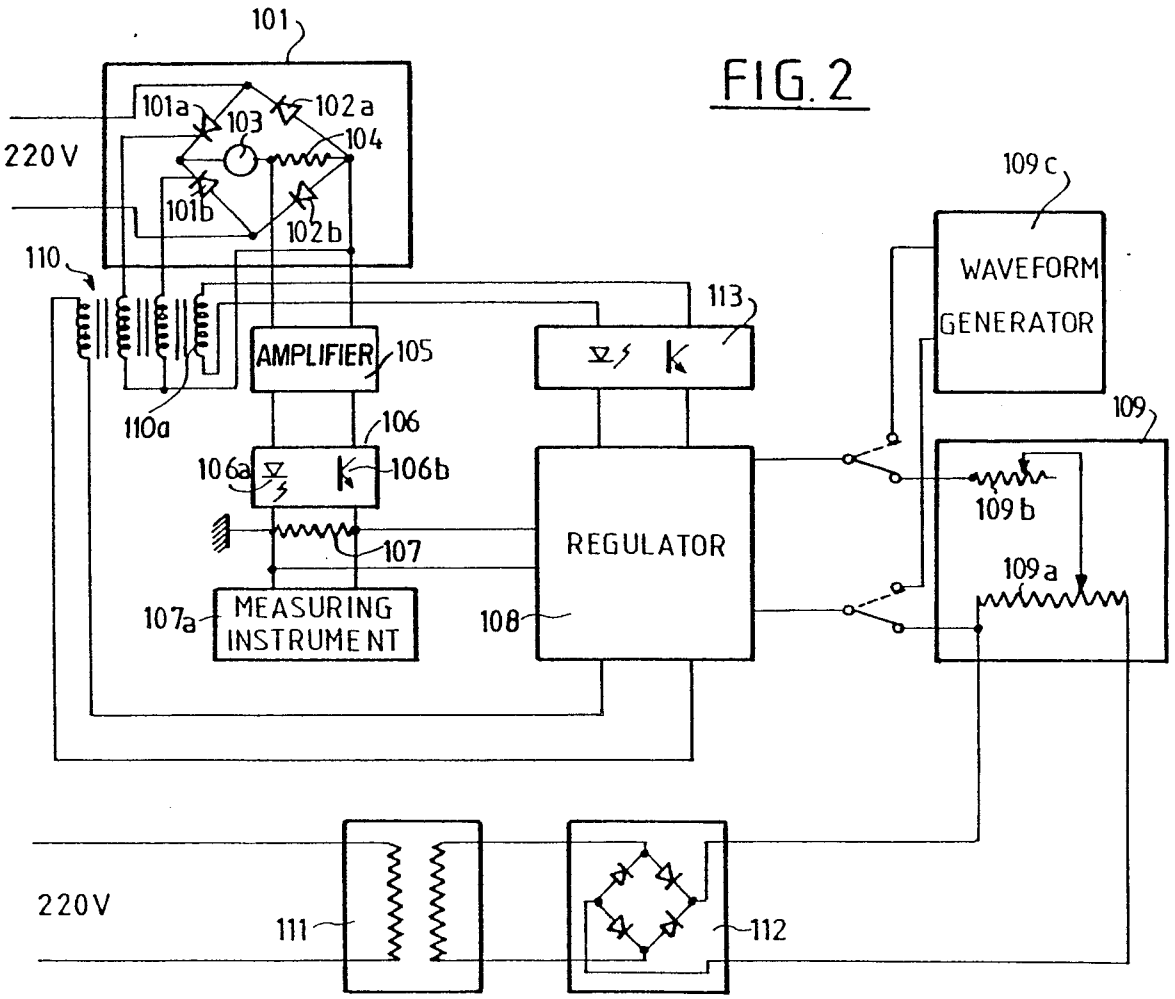
FIG. 2 is a diagram of an electronic circuit for varying the speed of the motor and suitable for use in the apparatus.

The FIG. 2 circuit serves to vary the speed of a DC motor whose stator field is produced by permanent magnets and whose armature is powered by 220-volt 50/60 Hz single-phase mains, and differs from similar conventional circuits by including isolating components of the optoelectronic type for improving handling safety.

A rectifier block 101 is fed from 220-volt 50-Hz mains and comprises two thyristors **101*a* and 101*b* associated with two rectifiers 102*a* and 102*b* mounted as a bridge across the mains. The armature 103 of the motor to be powered is connected in series with a shunt resistance 104 to the output terminals of the bridge, with the measuring shunt 104** thus having the same current flowing through it as flows through the armature.

The rectified voltage present across the terminals of the shunt is amplified by an amplifier 105 and is fed to an opto-electronic block 106 comprising a photodiode **106*a* controlling an output transistor 106*b* so as to generate a low level isolated voltage across an output resistor 107, thereby providing a signal representative of the speed of the motor. This signal is transmitted to a measuring instrument 107*a*** which may be a galvanometer or an input preamplifier to a recorder or to an oscilloscope.

The speed signal is also applied to the input of a regulator block 108 within which it is compared to a signal from an adjustment block 109 which is used to select the desired speed. A difference signal produced by the regulator block 108 is sent via an isolating transformer 110 to the control electrodes of the thyristors **101*a* and 101*b***.

The regulator block 108 and the adjustment block 109 are powered by a DC voltage of about 12 volts generated from the 200-volt 50-Hz mains by means of a transformer 111 and a rectifier bridge 112.

Finally, a compensation loop which is isolated by an opto-electronic assembly 113 having a photodiode and an output transistor connects the regulator block 108 to an auxiliary winding **110*a* of the control transformer 110** to modify the waveform of the input signal in order to ensure that the speed of the motor is stable at very low speeds.

The adjustment block 109 may comprise a manual adjustment potentiometer **109*a* having its fixed terminals fed by the low voltage DC from the rectifier bridge 112, with one of these fixed terminals and the variable terminal connected to the cursor producing an adjustable low voltage which is applied as the reference voltage to an input of the regulator block 108. This is a conventional manual control arrangement. A second adjustment potentiometer 109*b* has also been shown which is connected in cascade and which serves to vary the speed of the motor at any given position of the cursor of the potentiometer 109*a* as a function of a selected parameter, for example the position of the drum 2**, or time as provided by a timer circuit.

It would also be possible to provide a sawtooth current generator or a generator for providing a signal of variable shape depending on the exercise in question Such a generator referenced **109*c* in FIG. 2 may be switched to take the place of the manual adjustment block 109**.

A simple two-speed apparatus may use two isokinetic systems only. For example, two freewheels may be mounted respectively on the two ends of the stepdown gear output shaft, with a first drum of radius Ra being mounted directly on the outside of the first freewheel and a second drum of larger radius Rb being mounted to the second freewheel via a system of pulleys and belts providing a speed ratio P. A low speed cord is wound onto the first drum and a high speed cord onto the second drum, with the ratio of the uunwinding limit speeds of the two cords being equal to P.Rb/Ra.

Each of the two cords may be associated with its own spiral spring return member in the manner illustrated in FIG. 1. Alternatively, the cable which winds onto the variable diameter pulley of a single return device may be terminated by a pulley wheel which acts on a second cable whose two ends are wound onto respective ones of the two work drums, thereby providing action independently on the two work members from the return member Equipment similar to that described above but symmetrical to give rise to identical limit speeds on both cords may be used for the purpose of obtaining symmetrical alternating forces on two limbs.

When a source of electricity is not available, the electric motor may be replaced by a heat engine.

The knowledge of the unwinding limit speed is a fundamental data of the training which can be given by apparatus in accordance with the invention.

The speed can be determined in a system where the motor speed is continuously variable by marking various positions of the control potentiometer.

A more elaborate solution consists in displaying an analog or a digital indication of the speed as provided by measuring the motor regulating control voltage. For example, a conventional digital display device could be used comprising three seven-segment displays each associated with a pulse counter and with a decoding block. The counter associated with the first display counts the pulses provided by a generator from an analog measuring signal. A clock circuit enables counting to take place for a given period of time followed by resetting to zero. Each of the other count cells is connected to the preceding cell and to the clock circuit. Each decoding circuit is connected to the corresponding display via seven resistors.

The speed may also be displayed by a luminous range constituted, for example, by diodes driven by respective amplifiers, each of which compares the analog measuring signal with a different fraction of a reference voltage defined by a chain of resistors.

The stroke of the cord constitutes another parameter for monitoring exercises. It is possible to determine the angle turned through by the work drum 2 onto which the cord 1 is wound, for example, by means of a multiturn potentiometer 22 fixed to the drum (FIG. 1) so that its output voltage depends on the number of turns, with zero adjustment being provided by a button 23 acting on the potentiometer body. The potentiometer could be replaced by a pulse sensor associated with a toothed disk or with printed light and dark zones on the drum, with the pulse sensor then being constituted by an optical cell for counting light and dark zones.

Measuring the cord displacement indirectly by measuring drum rotation gives rise to an error due to the turns overlying one another on the drum. Direct measurement is preferable if high accuracy is required One device which is suitable for this purpose comprises an echo sounding transmitter/receiver fixed to the frame 100 where the cord leaves it, and directed by means of a toggle to emit an ultrasonic beam towards the handle 27. The handle includes a shield for reflecting ultrasound. The receiver produces an analog signal representative of the distance between the wall of the frame and the limb connected to the cord.

Figure 3:
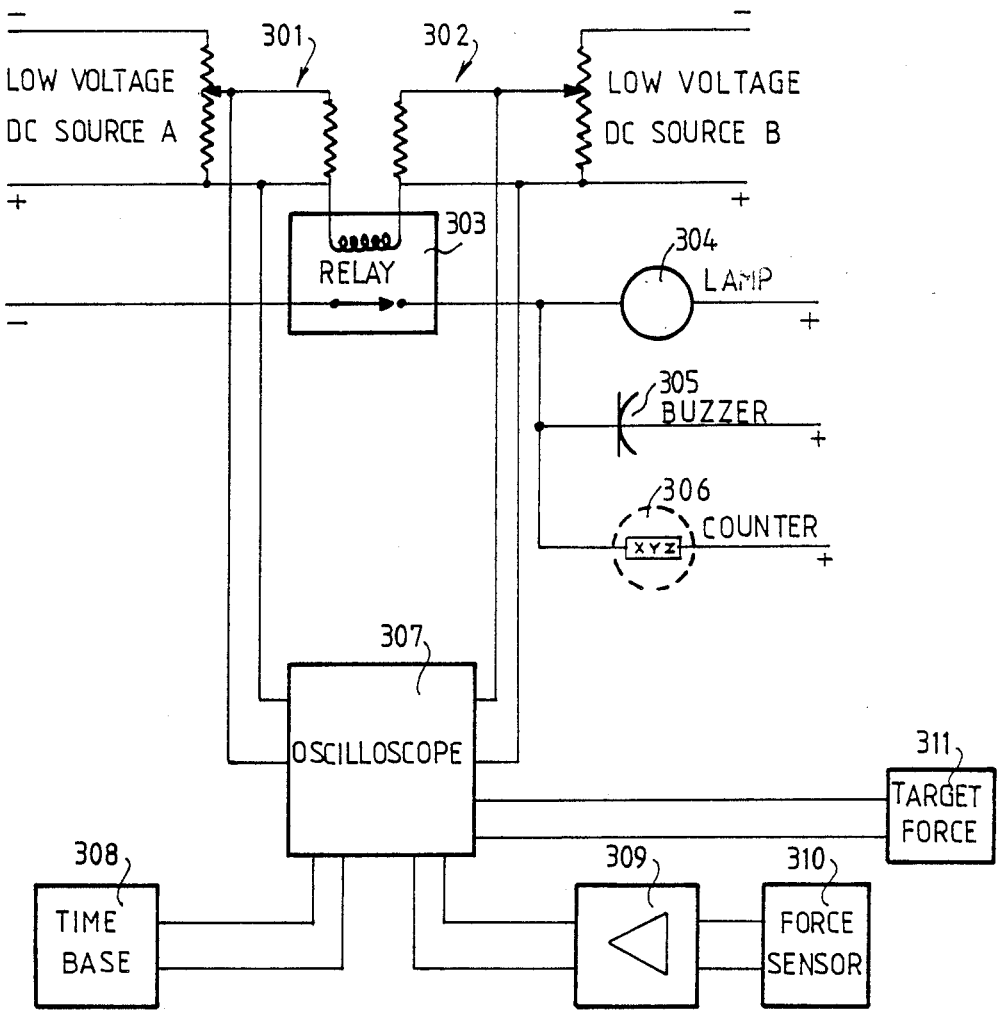
FIG. 3 is a diagram of a circuit for signalling and displaying the amplitude of movement performed during an exercise.

FIG. 3 shows an example of a circuit for making use of the measurement of cord unwinding. A first potentiometer 301 fed by the measurement signal provides a voltage representative of the extension of the movement being performed, while a second potentiometer 302 connected to a DC voltage source provides a voltage representative of the cord extension which is to be achieved during an exercise. When the difference between these two voltages becomes less than a threshold, a relay 303 feeds one or more indicator devices such as an indicator lamp 304, a buzzer 305, and/or a counter 306 for counting completed exercises. In addition, the voltages provided by the potentiometers are sent to a display device 307 such as a two-channel oscilloscope with high remanence. The oscilloscope's horizontal scanning may be controlled by a voltage which increases linearly over time as supplied by a time base 308 in order to provide a graph representative of the length unwound as a function of time, or it may be controlled by a voltage which is an increasing function of the force exerted by the operator as supplied by an amplifier 309 connected to a force sensor 310, thereby displaying the length of cord as a function of the effort exerted. In both cases, a horizontal line represents the reference voltage and serves to determine the instant or the force at which the target length of cord has been reached. Optionally, a voltage generator 311 supplies a voltage representative of a target force to be reached and is connected to the oscilloscope 307 in order to display a graph that shows the elongation at which the target force is achieved.

Figure 4:
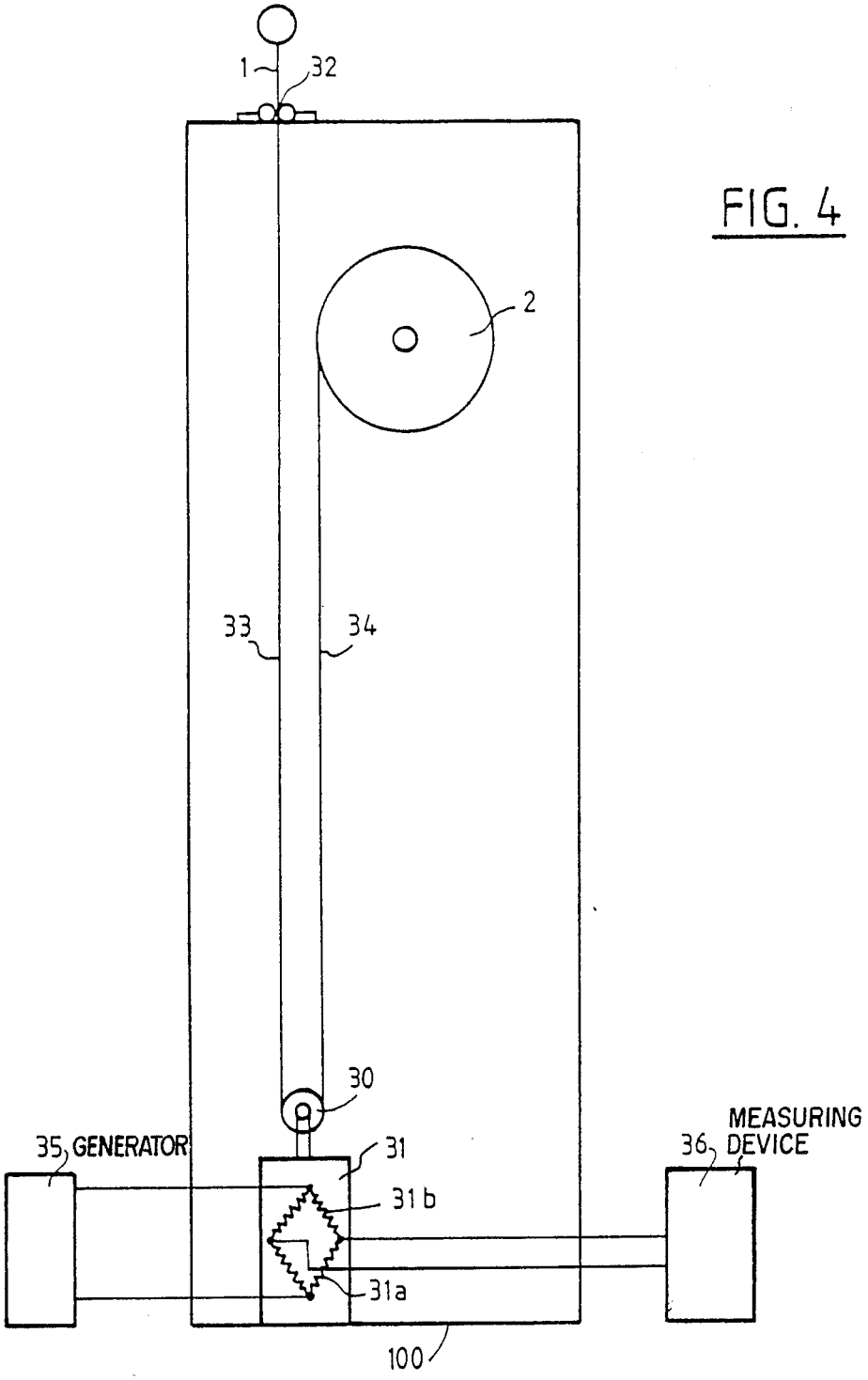

The force exerted on the cord by the operator may be determined by various different means. A particularly simple means is shown in FIG. 4 which is a diagram of some components in a variant of the apparatus. As it winds off the drum 2 (which is similar to that shown in FIG. 1 but is shown axially in this figure), and prior to leaving the frame between two guide rolls 32, the cord 1 is deflected by a pulley 30 which is connected to a force sensor 31 fixed to the frame 100. The reaction force opposing the operator force is then proportional to the force measured by the sensor 31 (ignoring friction between the cord and the rolls 32). Naturally, the axis of the pulley 30 is placed in such a manner that the length 34 of the cord between the drum and the pulley and the length 33 between the pulley and the rolls 32 are disposed symmetrically about the direction of the force transmitted to the sensor 31. The coefficient of proportionality depends on the angle between the lengths 33 and 34 and is equal to 1 when the lengths are parallel, as shown.

In an isokinetic apparatus, a force sensor which is greatly deformed under load, for example a spiral spring balance, should be avoided since it would disturb the stroke of the cord It is preferable to use a sensor which deforms very little, comprising, for example, a strain gauge bridge 31*a*, 31*b* whose microdeformations under load give rise to an off-balance electric voltage across the output terminals of the bridge when a low electric voltage is applied to its input terminals by a generator 35. The off-balance voltage is amplified and picked up by a measuring device 36 including an analog output and capable of controlling a threshold relay and the various abovedescribed functions for making use of signals (visual or audible signalling, counting and/or recording of the analog signal).

However, if it is desired to make use solely of the information that a certain force threshold is exceeded, the sensor 31 may be constituted by a mechanical balance which does not deform greatly, and which at a given deformation closes an electrical switch in order to trigger appropriate signalling.

A variant of the force measuring device is shown in FIG. 5. A pulley 42 has the cord 1 passing thereover and here again there are two symmetrically disposed lengths 43 and 44 one of which leads to the drum 2 and the other of which leads to the outlet guide rolls 59, with the pulley deforming a deformable element 41. The deformable element comprises a spring 41*a* working in compression and a rod 41*b* connected to the moving end of the spring and having one end carrying a magnetic element 41*c*. This element acts on a magnetic relay 45 of the ILS type and the vertical position of the relay is adjustable by means of a screw 46. Relay contact is established at a given compression of the spring 41*a* which corresponds to a force determined by the operator. The sensor 41 described above may be replaced by the weighing system taken from a bathroom scales type balance from which the measured weight is remotely transmitted by means of an infrared system, and is then decoded and displayed on a screen.

The force measuring devices described above provide a result which is degraded by errors due to friction. This drawback may be eliminated by the device shown in FIG. 6, in which the handle 60 by which the operator is connected to the end of the cord 1 is fitted with a flat deformable capsule 62 which is sensitive to traction force or to compression force exerted between the cord and the operator, and which has a measuring device 63 glued thereto based on strain gauges conventionally connected as a bridge. The bridge may be powered by a miniature battery 64 associated with a contact 65 that is responsive to compression so as to close only when the operator is doing work and thus avoid wasting the battery when the apparatus is at rest. The battery and the contact may be incorporated in the handle 60.

The off-balance signal from a bridge may be directed to the frame 100 by an electrical cable 67 having two or three cores and wound on a winch 69 operated by a motor 68 similar to that provided for rewinding the cord 1. The cable 67 enters the frame via a guide window 70 close to the guide window 59 for the cord so as to limit both the incidence of the cable 67 on the reaction force transmitted by the cord 1 to the operator, and also the risk of the cable becoming tangled with the cord.

The transmission of the measurement signal by a cable 67 may be replaced by transmission using radiation from an emitter fixed to the handle 60, for example in the form of a pulse signal whose emission frequency is fixed and whose amplitude is proportional to the analog signal of the off-balance voltage of the bridge 63. A receiver housed in a measuring box 66 transforms the signal from the emitter 71 onto an analog signal. Naturally, it is also possible to connect the handle 60 to the box 66 via an electrical cable, or else to house the receiver associated with the emitter 71 in the frame 100.

The means for measuring displacements and force has been described above with reference to the isokinetic work system, with which they are more particularly advantageous. However, they may also be used with a two-force drive system or simultaneously with both types of system.

The frame 100 of the apparatus may be in the form of a rectangular parallelipiped and may be made of welded tubes 400 (FIG. 7) constituting a rigid structure having bearing elements for guiding the traction cord fixed thereto together with auxiliary bearing or block-and-tackle elements which the operator may require in order to provide force. The frame also includes means for fixing it to a wall or for permanently attaching it to a pillar, a bracket or any other support capable of withstanding forces.

Figure 7:
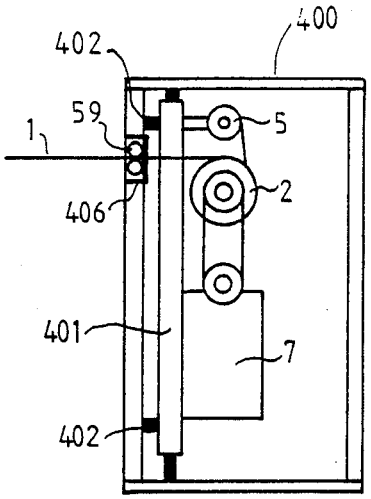
FIG. 7 is a diagram showing one way of mounting the mechanical components in the frame of the apparatus.
Figure 8:
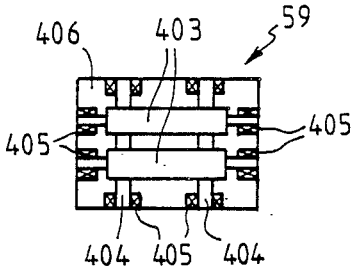
FIGS. 8 and 9 show details of the guide window through which the work cord passes.

The mechanical elements and in particular the work member 2, the drive element 5, and the assembly providing the opposing force, are advantageously mounted on a plate 401 fixed to the frame 400 by means of dampers 402, for example of the silent-block type, so as to reduce the vibration and noise produced by the moving mechanism (see FIG. 7). The guide window through which the cord passes must be capable of withstanding large forces while giving rise to as little friction as possible. As shown in FIG. 8, it is preferably constituted by two pairs of cylinders, one pair of cylinders 403 having parallel axes and another pair of cylinders 404 having mutually parallel axes which are perpendicular to the axes of the cylinders 403, with all four cylinders rotating in bearings 405 supported by a plate 406. Where appropriate a plurality of such windows are provided, one for guiding each of the cords that needs guiding.

Figure 9:
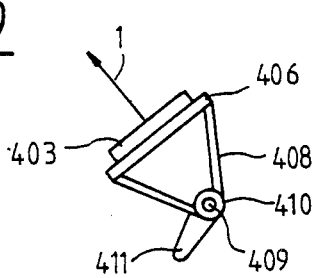

Still for the purpose of reducing friction, it is desirable for the guide window 59 to be placed in such a manner as to reduce the extent to which the cord is deflected on passing therethrough. To this end, it is advantageous for the position of the plate 406 on the frame to be adjustable. Thus, the plate 406 may be slidably mounted on slides fixed to the tubular frame and placed on the front face thereof for front traction or on the top face thereof for vertical traction, with a rapid clamping device enabling the plate 406 to be fixed. The plate may also be supported by a rotary equipment comprising two arms 408 connected to a shaft 409 by a bearing 410, with the shaft 409 being fixed to the tubular frame 400 or to the plate 401 (FIG. 9). A lever 411 serves to lock the bearing 410 in a position corresponding to the traction direction of the cord.

The faces of the apparatus may be constituted by removable elements such as metal or plastic plates including decoration and reference marks for the adjusting or measuring devices, and optionally supporting various measuring items on their inside faces. These plates may also be lined with noise absorbing materials.

Figure 10:
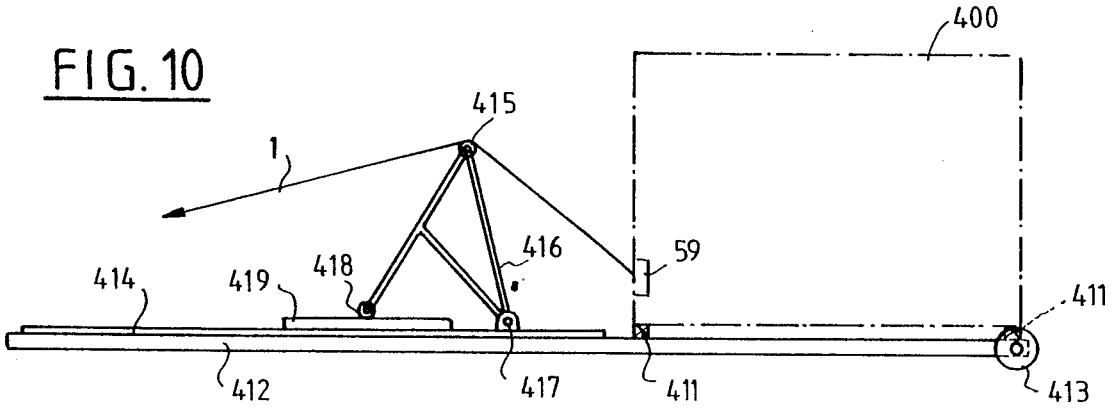
FIGS. 10 and 11 are respectively an elevation view and a plan view of a chassis for supporting the apparatus and the operator.
Figure 11:
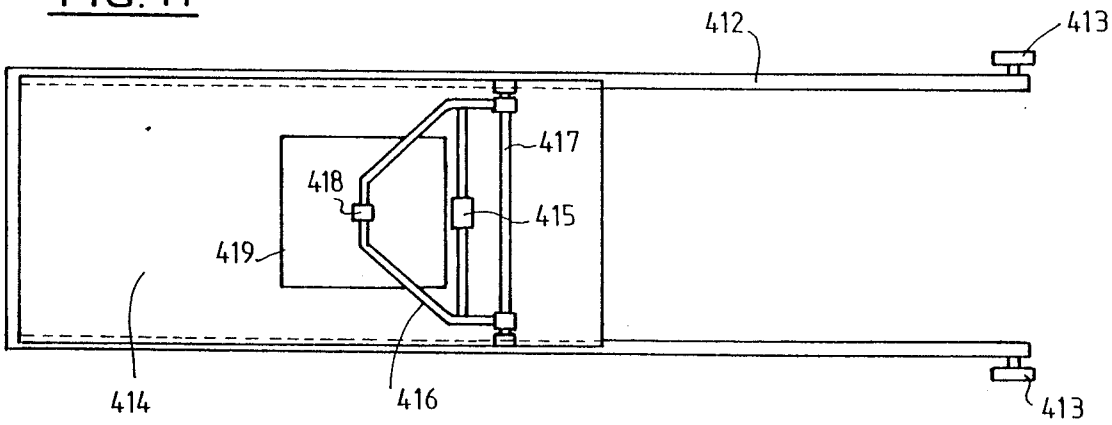

FIGS. 10 and 11 show an additional tubular chassis 412 which may be fixed to the frame 100 of the apparatus by means of legs 411 fixed to the tubular frame 400. Wheels 413 enable the assembly to be transported more easily. A support plate 414 is fixed to the chassis 412 and the operator may stand on the support plate 414 so that the operator's own weight and the reaction force exerted on the operator by the apparatus serve to prevent the apparatus from moving regardless of the forces developed by the operator by pulling on the cord 1. The plate 414 may be used to mount any directional pulley that may be required for performing a particular movement with the cord, and also for any other equipment for measuring force, in particular the equipment shown in FIG. 6. In particular, the cord 1 leaving the guide window 59 may press against a wheel 415 mounted on a non-deformable frame 416 which is pivotable about a shaft 417 fixed to the plate 414 and which presses via a roll 418 against the middle of the stand of scales 419 which record a component of the traction force exerted by the operator on the cord.

I claim:

1. Apparatus for training, investigation, and reeducation, in particular for the neuro-muscular function, the apparatus comprising:

a fixed frame;

at least one work member attached to said frame for connection to a subject to be exercised and capable of moving in a first direction and in a second direction opposite to the first direction;

a respective return member attached to said frame including mechanical energy storing means connected to each said work member to store energy in said mechanical energy storing means when said subject moves the work member in the second direction and to release energy when the work member moves in the first direction, said return member urging the work member to displace the work member in the first direction;

a drive member attached to said frame adapted to run in a given direction at a selected velocity, wherein said selected velocity is chosen from a range which includes zero velocity; and an irreversible transmission device connected between the drive member and the work member in order to urge said work member in said first direction, solely when the velocity of the work member measured with respect to the second direction is not less than a predetermined threshold proportional to said selected velocity.

2. Apparatus according to claim 1, wherein each work member comprises a rotary drum, a cord wound on said rotary drum, and grasping means fixed to said cord.

3. Apparatus according to claim 2, wherein each mechanical energy comprises rotary means comprises a spiral spring driving a cable having one end attached to the drum.

4. Apparatus according to claim 2, wherein the frame includes an outlet window for the cord, said window comprising two pairs of parallel cylinders which are oriented in manually perpendicular directions.

5. Apparatus according to claim 1, wherein the drive member is a rotary motor and wherein the transmission device includes an irreversible stepdown gear and at least one one-way transmission element.

6. Apparatus according to claim 5, wherein the stepdown gear is of the worm gear type.

7. Apparatus according to claim 1, wherein said predetermined threshold is positive with respect to said second direction.

8. Apparatus according to claim 1, wherein said predetermined threshold is negative with respect to said second direction.

9. Apparatus according to claim 1, comprising two work members.

10. Apparatus according to claim 9, wherein the transmission device includes a common stepdown gear and two one-way transmission elements for connection with respective work members.

11. Apparatus according to claim 9, wherein said predetermined threshold is positive with respect to said second direction.

12. Apparatus according to claim 9, wherein said predetermined threshold being negative with respect to said second direction.

13. Apparatus according to claim 9, wherein said transmission device is connected to a first work member so as to exert a force thereon solely when the first work member moves at a velocity not less than a first predetermined threshold, wherein said first predetermined threshold being positive with respect to said second direction and to a second work member so as to exert a force thereon solely when the second work member moves at a velocity not less than a second predetermined threshold, wherein said second predetermined threshold being negative with respect to said second direction.

14. Apparatus according to claim 13, wherein the two work members are interconnected so that a movement by the subject to be exercised is accompanied by a combined displacement of the two work members in the first direction or in the second direction.

15. Apparatus according to claim 1, further including means for varying said predetermined threshold.

16. Apparatus according to claim 1, further including means for displaying said predetermined threshold of the work member.

17. Apparatus according to claim 1, further including means for measuring the displacement performed by the work member during an exercise.

18. Apparatus according to claim 1, further including means for measuring the force exerted by the subject on the work member.

19. Apparatus according to claim 1, further including means for measuring a property associated with the work member, said property being selected from the group consisting of: the predetermined threshold, the displacement, and the force exerted thereon; and means for at lest one of signalling and counting which are excited when a measured property reaches a predetermined value.

20. Apparatus according to claim 1, further including means for measuring a property associated with the work member, said property being selected from the group consisting of: the predetermined threshold, the displacement and the force exerted thereon; and means for displaying the value of said measured property as a function of time.

21. Apparatus according to claim 1, wherein the frame is fixed to a chassis supporting a plate on which the subject is placed while the apparatus is in use.

22. Apparatus according to claim 1, further including means for measuring a first property and a second property associated with the work member; said first and second properties being selected from the group consisting of: the predetermined threshold, the displacement and the force exerted thereon; and means for displaying said first property as a function of said second property.

23. Apparatus for training, investigation, and re-education, in particular for the neuro-muscular function, the apparatus comprising:

a fixed frame;

at least one work member attached to said frame for connection to a subject to be exercised and capable of moving in a first direction and in a second direction opposite to the first direction;

a respective return member attached to said frame including mechanical energy storing means connected to each said work member to store energy in said mechanical energy storing means when said subject moves the work member in the second direction and to release energy when the work member moves in the first direction, said return member urging the work member to displace the work member in the first direction;

a drive member attached to said frame adapted to run in a given direction at a selected velocity; and an irreversible transmission device connected between the drive member and each work member in order to urge said work member in said first direction, solely when the velocity of the work member measured with respect to the second direction is not less than a predetermined threshold proportional to said selected velocity;

wherein each work member comprises a rotary drum, a cord wound on said rotary drum, and grasping means fixed to said cord;

wherein each mechanical energy storing means comprises a spiral spring driving a cable having one end attached to the drum;

wherein the other end of the cable winds onto a pulley whose diameter varies along its axis.

24. Apparatus for training, investigation, and re-education, in particular for the neuro-muscular function, the apparatus comprising:

a fixed frame;

at least one work member attached to said frame for connection to a subject to be exercised and capable of moving in a first direction and in a second direction opposite to the first direction;

a respective return member attached to said frame including mechanical energy storing means connected to each said work member to store energy in said mechanical energy storing means when said subject moves the work member in the second direction and to release energy when the work member moves in the first direction, said return member urging the work member to displace the work member in the first direction;

a drive member attached to said frame adapted to run in a given direction at a selected velocity and; and an irreversible transmission device connected between the drive member and each work member in order to urge said work member in said first direction, solely when the velocity of the work member measured with respect to the second direction is not less than a predetermined threshold proportional to said second velocity;

wherein said irreversible transmission device is connected to at least one work member so as to exert a force thereon solely when the work member moves at a velocity not less than a predetermined threshold said predetermined threshold being negative with respect to said second direction;

wherein the transmission device includes a force coupler for transmitting an adjustable torque.

25. Apparatus according to claim 24, further including means for varying the adjustable torque, wherein said torque varying means is provided to vary the torque transmitted by the force coupler as a function of the direction of displacement of the work member.

* * * * *